US010046871B2

(12) United States Patent
Marz

(10) Patent No.: US 10,046,871 B2
(45) Date of Patent: Aug. 14, 2018

(54) ELECTRONIC CIGARETTE AND FLUID DISPENSING SYSTEM

(71) Applicant: Keith Marz, Sherman Oaks, CA (US)

(72) Inventor: Keith Marz, Sherman Oaks, CA (US)

( * ) Notice: Subject to any disclaimer, the term of this patent is extended or adjusted under 35 U.S.C. 154(b) by 73 days.

(21) Appl. No.: 14/922,943

(22) Filed: Oct. 26, 2015

(65) Prior Publication Data

US 2017/0113819 A1 Apr. 27, 2017

Related U.S. Application Data

(60) Provisional application No. 62/069,984, filed on Oct. 29, 2014.

(51) Int. Cl.
*A24F 47/00* (2006.01)
*B65B 3/12* (2006.01)

(52) U.S. Cl.
CPC ..... *B65B 3/12* (2013.01); *A24F 47/002* (2013.01)

(58) Field of Classification Search
CPC ..... B65B 3/12; A24F 47/002
See application file for complete search history.

(56) References Cited

U.S. PATENT DOCUMENTS 4,592,348 A * 6/1986 Waters, IV ..... A61M 15/0091 128/200.23
8,757,169 B2 6/2014 Gysland
9,095,175 B2 * 8/2015 Terry ..... A24F 47/008
9,155,337 B2 10/2015 Duncan et al.
9,427,711 B2 * 8/2016 Terry ..... A24F 47/008
9,555,203 B2 * 1/2017 Terry ..... A24F 47/008
9,668,522 B2 * 6/2017 Memari ..... B65B 3/04
2008/0247892 A1 * 10/2008 Kawasumi ..... F04B 43/12 417/476
2010/0200008 A1 * 8/2010 Taieb ..... A24F 47/008 131/360
2011/0036346 A1 * 2/2011 Cohen ..... A61M 15/0065 128/200.14
2011/0277764 A1 * 11/2011 Terry ..... A24F 47/008 128/203.26
2015/0136156 A1 5/2015 Liu

* cited by examiner

*Primary Examiner* — Nicolas A Arnett

(57) ABSTRACT

An electronic cigarette and fluid dispensing system (E-Cig FDS) that utilizes an electronic cigarette (e-cig) having an inner end, an outer end, and an outer surface with a first aperture and a second aperture, and a keyed fluid dispenser having a body with an inner surface, an outer surface, an open first end, and a second end. Located within the body at the first end is a plunger that can slideably move inside the body. Extending from the body's second end is an injector dimensioned to interface with the first aperture or second aperture. The fluid facilitates the smoking, or vaping, of the e-cig. A user can selectively choose if the fluid is safe, non-nicotine or nicotine-infused. The E-Cig FDS provides visual differentiation of the type of fluid that is being smoked, or vaped.

8 Claims, 3 Drawing Sheets

ELECTRONIC CIGARETTE AND FLUID DISPENSING SYSTEM

TECHNICAL FIELD

The invention generally pertains to electronic cigarettes, and more particularly to an electronic cigarette and a keyed cigarette fluid dispenser that allows a differentiation of whether safe non-toxic fluid is being used, or nicotine-infused fluid is being used.

BACKGROUND ART

One of the most controversial products to have been recently developed is an electronic cigarette, which is known as an E-cig. Most E-cigs have a similar appearance to a conventional tobacco cigarette. The difference is that an E-cig is an electronic device which allows a person to inhale a quantity of substance and exhale a composition of water vapor. The substance that is typically inhaled from an E-cig is nicotine thereby allowing a person to receive the nicotine to which they are addicted without any of the negative aspects of smoking tobacco which includes numerous harmful additives.

E-cigs are available in two embodiments: the first is a non-refillable, often single-use E-cig. The second is an E-cig that can be re-filled with nicotine fluid, thereby allowing a person to purchase an E-cig and simply re-fill it when it becomes depleted. As time has progressed, E-cig manufacturers have discovered that there are individuals who do not want to inhale, nicotine. For these individuals E-cig fluids containing various flavoring and/or healthy ingredients such as vitamins have become available.

Recently there has been serious debate about the health concerns associated with inhaling nicotine by E-cig users, and the "second-hand-smoke" that is experienced by non-users who are in the vicinity of a person using an E-cig. There has not been any definitive proof of the danger of nicotine based c-cigs, but it is widely believed the U.S. Government will soon implement laws that dictate who can use an E-cig and where an E-cig cannot be used. There has been conflicted proof of the danger of nicotine based E-cigs, but local governments have begun to implement laws that dictate who can use an E-cig and where an E-cig cannot be used, thereby casting a blanket over E-cigs with nicotine and without.

Unfortunately, it is expected that these laws will also apply to non-nicotine E-cigs which do not present any danger to a user or a person in the vicinity of a user. This is because it is currently impossible to determine if an E-cig is using nicotine fluid or non-nicotine fluid.

What is needed is a method to ensure which fluid nicotine or non-nicotine—is used with a particular E-cig. And, to provide a definitive way of visually identifying/differentiating a nicotine E-cig from a non-nicotine E-cig.

A search of the prior art did not disclose any literature or patents that read directly on the claims of the instant invention. However, the following U.S. patents are considered related:

| PAT. NO. | INVENTOR | ISSUED |
|---|---|---|
| 8,757,169B2 | Gysland | 24 Jun. 2014 |
| 9,155,337B2 | Duncan, et al | 13 Oct. 2015 |
| 2015/0136156 | Liu | 21 May 2015 |

The U.S. Pat. No. 8,757,169B2 discloses an electronic cigarette including an atomizer, a cartridge, a mouthpiece, a power switch, and an electronic cigarette refilling apparatus. A method of dispensing a liquid into an electronic cigarette and a method of inhaling a vapor from an electronic cigarette are also disclosed.

The U.S. Pat. No. 9,155,337B2 discloses an electronic cigarette having a housing, an atomizer disposed in the housing, and a control circuit disposed in the housing and configured to control operation of the atomizer based on time data regarding a current time.

The 2015/0136156 publication disclosed an electronic cigarette and an electronic cigarette device. The electronic cigarette comprises a power supply, a liquid storage member storing liquid smoke, an atomizing unit and a controller connected with the power supply and the atomizing unit for controlling the atomizing unit to start or stop heating. The atomizing unit comprises an oil accumulating member and an electric heating piece attached to the oil accumulating member. The electronic cigarette is configured with an electric heating piece in the atomizing unit instead of traditional heating wire.

DISCLOSURE OF THE INVENTION

In its basic design, the electronic cigarette and fluid dispensing system (E-Cig FDS) is comprised of an electronic cigarette (e-cig) having an inner end, an outer end, and an outer surface with a first aperture or a second aperture, and a keyed fluid dispenser having a body with an inner surface, an outer surface, an open first end, and a second end. The body is preferably circular and made of plastic. Located within the body at the first end is a plunger that can slideably move inside the body from the first end to the second end. Extending outward from the body's second end is an injector having a first end and a second end. The injector's first end extends through the body's second end. The injector is dimensioned to interface with the first aperture or the second aperture to facilitate the insertion of safe, non-nicotine fluid or nicotine fluid. The dispenser holds the fluid prior to the fluid being inserted into the e-cig. The fluid facilitates the smoking or vaping of the e-cig. A user can selectively choose if the fluid is a safe fluid without nicotine, or a nicotine-infused fluid. The E-Cig FDS has means for visually differentiating which type of fluid is being smoked, or vaped.

In view of the above disclosure, the primary object of the invention is to provide an electronic cigarette and fluid dispensing system that allows safe non-harmful fluid or a nicotine fluid to be inserted into the electronic cigarette, and for an electronic cigarette using safe non-harmful fluid to be visually or by other means differentiated from an electronic cigarette using nicotine fluid.

In addition to the primary object, it is also an object of the invention to provide an electronic cigarette and fluid dispensing system that:

- is easy to use,
- can utilize a variety of fluids, including vitamin-infused and/or flavored non-nicotine or nicotine fluid,
- allows the use of the type of fluid in an electronic cigarette to be controlled and monitored,
- is disposable and bio-degradable.
- is safe and hygienic.
- can be easily identified, even at a distance,
- is cost effective from both a manufacturer's and consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms that disclose embodiments of an electronic cigarette and fluid dispensing system 10 (E-Cig FDS 10).

Currently there is serious debate regarding the safety of using and being exposed to electronic cigarettes (e-cigs). The main issue is whether the inhaled nicotine from an e-cig is harmful to a person, and if the exhaled water vapor, which contains nicotine creates harmful "second-hand smoke" to which people in the vicinity of an e-cig are exposed.

The U.S. government is considering several potential solutions to the problems associated with e-cigs, including banning the use of e-cigs in all public areas. This solution does not please users of safe non-nicotine e-cigs. It is possible that e-cigs will fall under the same rules and regulations as cigarettes, making the separation of those with nicotine and without almost impossible. The instant E-Cig FDS 10 provides a solution to the problem of differentiating potentially harmful nicotine-based e-cigs from safe non-nicotine based e-cigs.

As is well known in the art, e-cigs are filled with a fluid 40, which is a nicotine composition or can be composed of other substances including vitamins or other non-harmful ingredients. The E-Cig FDS 10, as shown in FIGS. 1-7, comprises a combination of an e-cig 12 and a keyed fluid dispenser 32 that allows non-harmful fluid to be inserted into the e-cig 12, and for nicotine fluid to only be inserted into a selected and identified e-cig 12.

Figure 1:
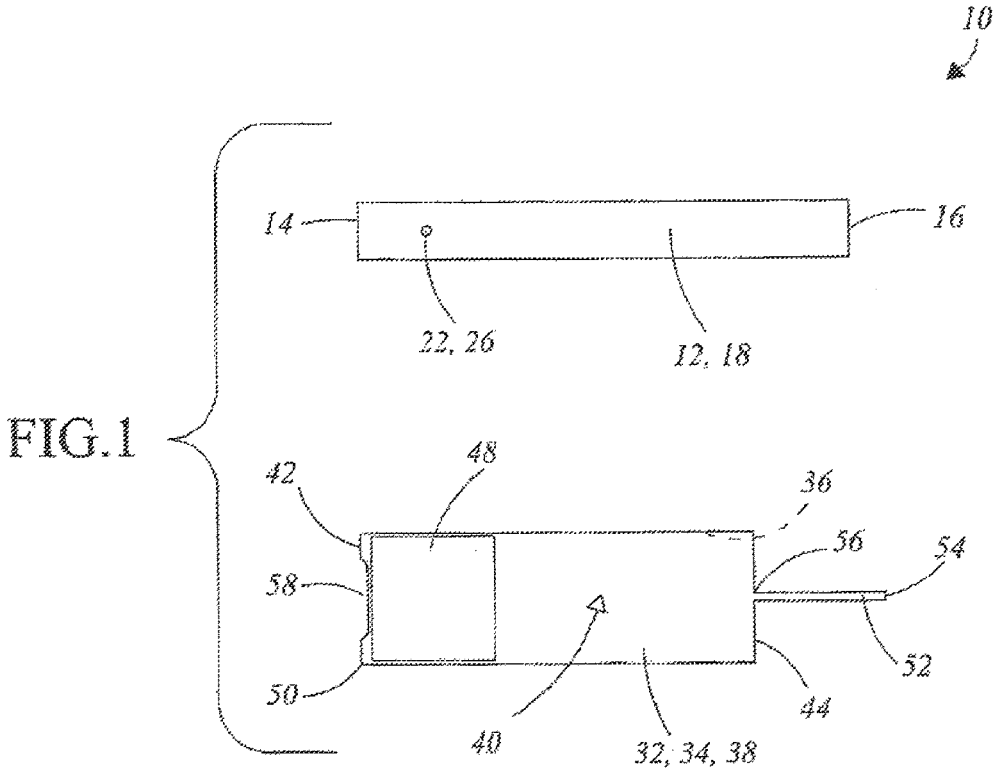
FIG. 1 is a top plan view of an electronic cigarette and fluid dispensing system (E-cig FDS) having an electronic cigarette (E-cig) and fluid dispenser with a plunger and injector.
Figure 2:
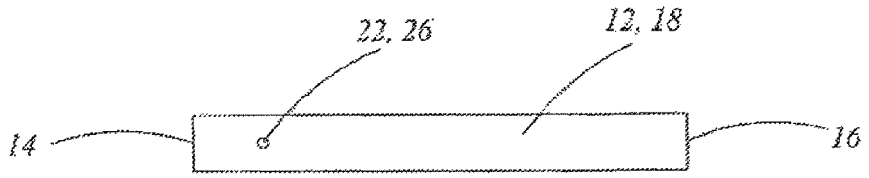
FIG. 2 is a top plan view of an E-cig having an aperture.

The e-cig 12, as shown in FIGS. 1, 2, 6 and 7, is comprised of an inner end 14, an outer end 16 which is the tip, and an outer surface 18. Within the c-cig 12 are the typical components that facilitate the operation of the e-cig. Located on the outer surface 18 is a first aperture 22 or a second aperture 26, as shown in FIGS. 1 and 2. The first aperture 22 which is designated as the safe aperture for use with vitamin-based or other non-nicotine fluid has a specific dimension. For the purpose of this disclosure the first aperture's dimension is 1.0 mm. The second aperture 26 is designated as the nicotine aperture. For this disclosure the nicotine aperture's dimension is 1.5 mm.

The fluid dispenser 32, as shown in FIGS. 1, 3, 4 and 5, is comprised preferably of a circular shaped body 34 having an inner surface 36, an outer surface 38, an open first end 42 and a second end 44. Within the body 34 at the first end 42 is a plunger 48 that can slideably move inside the body 34 from the first end 42 to the second end 44. Optionally, a lip 50 can extend inward around the perimeter of the open first end 43, as shown in FIG. 1. The lip 50 maintains the plunger 48 within the body 34, making it impossible to pull the plunger 48 out from the open first end 42. The plunger 48 is made of a slightly expandable material, preferably rubber. If the dispenser body 34 does not include the pre-disclosed lip 50 and the plunger 48 is pulled out from the first end 42, the plunger 48 will slightly expand, thereby making it impossible to reinsert the plunger 48 into the body 34.

Figure 3:
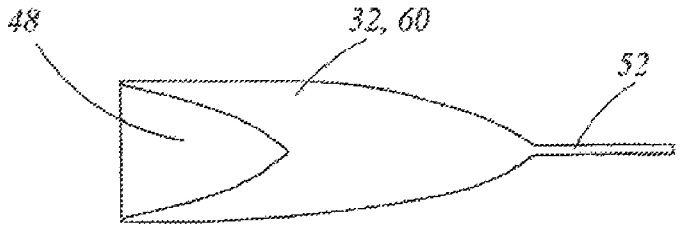
FIG. 3 is a top plan view of a fluid dispenser having a tapered body and corresponding tapered plunger.
Figure 4:
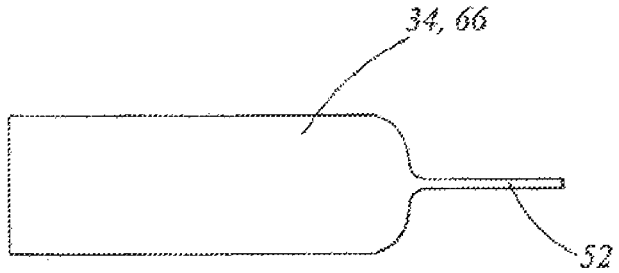
FIG. 4 is a top plan view of a fluid dispenser having a squeezable body.
Figure 5:
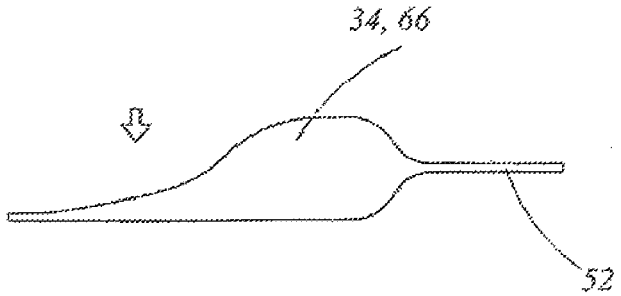
FIG. 5 is a side elevational view of a fluid dispenser having a squeezable body with a portion of the body squeezed to expel the fluid within the dispenser.

Extending outward from the body's second end 44 is an injector 52 having a first end 54 and a second end 56. As shown in FIGS. 1, 3 and 4, the injector's first end 54 extends through the body's second end 44. The injector 52 is hollow similar to a hypodermic syringe, therefore a fluid within the body 34 can flow out of the body through the injector 52. The injector 52 can be made of metal or plastic and is dimensioned to interface with the first or second aperture 22,26 on the E-cig 12. For safe non-nicotine fluid the injector is dimensioned to fit into the first aperture 22, so for this disclosure the safe injector is 1.0 mm. The nicotine fluid injector is dimensioned to fit into the second aperture 26, so for this disclosure the nicotine injector is 1.5 mm. This functionality presents the main inventive improvement the E-Cig FDS 10 has over conventional e-cig systems. By utilizing the two different sized aperture and injector combinations, the insertion of nicotine or non-nicotine fluid can be controlled. The 1.0 mm dimension of the non-nicotine aperture and injector allow the safe non-nicotine fluid to be inserted into the corresponding e-cig. The larger 1.5 mm dimension of the nicotine aperture and injector allows the nicotine fluid to be inserted into the corresponding e-cig. If desired, a person could insert the safe non-nicotine fluid 1.0 mm injector into the 1.5 mm aperture of the nicotine E-cig, but the 1.5 mm injector of the nicotine dispenser will not fit into the 1.0 mm aperture of the safe non-nicotine e-cig.

Since the fluid dispenser 34 is designed to be manufactured with the fluid pre-inserted and with the plunger 38 being non-removable or non-replaceable, the dispenser 32 is single-use and disposable. The fluid dispenser 34 cannot be re-filled and re-used. Therefore, a person cannot fill an empty safe, non-nicotine dispenser with nicotine fluid.

As previously disclosed, the fluid dispenser 34 is preferably circular shaped. In another design the dispenser 34 body can taper towards the second end 44, as shown in FIG. 3. The tapered body design would require a plunger with a corresponding tapered shape. The tapered body and plunger would facilitate better flow of the fluid from the body into the injector 52.

Figure 6:
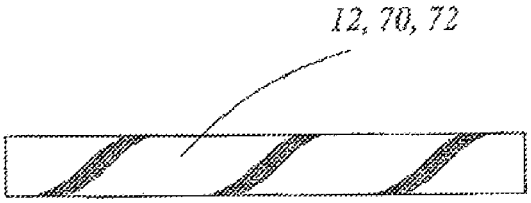
FIG. 6 is a side elevational view of an E-cig having identifying stripes.
Figure 7:
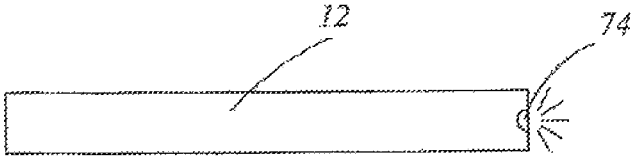
FIG. 7 is a side elevational view of an E-cig having a light at the tip.

As part of the E-Cig FDS 10, the e-cig 12 will provide users and observers with the ability to identify which type of fluid is inserted into a particular e-cig 12 and whether nicotine-laced water vapor is emanating from the e-cig and/or being exhaled by the user. This is accomplished by identifying each respective safe non-nicotine e-cig and nicotine e-cig. Indicia 70, such as various colors, words, or stripes 72, as shown in FIG. 6, can be placed on each e-cig. For example, a safe non-nicotine e-cig can be colored yellow, and a nicotine e-cig can be colored red, or a nicotine e-cig can have multiple red stripes. Alternately, a light consisting of an LED 74 can be placed on the outer end 16/tip of the e-cig, as shown in FIG. 7. A blue LED could indicate a safe non-nicotine e-cig and a yellow LED could indicate a nicotine e-cig. These are just examples, and other identification means are also contemplated to distinguish a safe non-nicotine e-cig from a nicotine e-cig.

The main inventive purpose and improvement that the E-Cig FDS 10 provides a way of differentiating when a safe, non-toxic fluid or a dangerous, nicotine-infused fluid is being inhaled, as well as a quick and easy method of using an e-cig and re-filling an e-cig with fluid. The E-Cig FDS 10 utilizes a disposable single-use dispenser that ensures the fluid within the dispenser is either safe non-nicotine or nicotine, and the dispenser cannot be modified to allow nicotine fluid to be inserted into a non-nicotine e-cig.

While the invention has been described in detail and pictorially shown in the accompanying drawings it is not to be limited to such details, since many changes and modification may be made to the invention without departing from the spirit and the scope thereof.

The invention claimed is:

1. An electronic cigarette and fluid dispensing system (E-Cig FDS) that comprises an electronic cigarette (e-cig) having an inner end, an outer end, and an outer surface with a first aperture and a second aperture, and a keyed fluid dispenser having a body with an inner surface, an outer surface, an open first end, and a second end, wherein said first aperture is designated a safe aperture which is dimensioned to allow the insertion of a safe non-nicotine fluid into said e-cig, and said second aperture is designated a nicotine aperture which is dimensioned to allow the insertion of a nicotine-infused fluid into said e-cig, wherein said keyed dispenser is dimensioned to interface with one of said first aperture or said second aperture, and wherein located within said body at the first end is a plunger that can slideably move inside said body from the first end to the second end, wherein extending outward from said body's second end is an injector having a first end and a second end, with the injector's first end extending through said body's second end, and with said injector dimensioned to interface with said first aperture or said second aperture to facilitate the insertion of safe, non-nicotine fluid or nicotine fluid into said c-cig, wherein said dispenser is utilized to hold the fluid prior to the fluid being inserted into said e-cig via said first aperture or said second aperture, wherein the fluid facilitates the smoking, or vaping, of said e-cig, wherein a user selectively chooses if the fluid is a safe fluid without nicotine, or a nicotine infused fluid, wherein said E-Cig FDS having means for visually differentiating which type of fluid is being smoked, or vaped.

2. The electronic cigarette and fluid dispensing system as specified in claim 1 wherein the non-nicotine fluid is a vitamin-infused fluid.

3. The electronic cigarette and fluid dispensing system as specified in claim 1 wherein said plunger is made of an expandable material, wherein if said plunger is pulled out from the first end of said dispenser's body, said plunger will expand, thereby making it impossible to re-insert said plunger into said dispenser's body.

4. The electronic cigarette and fluid dispensing system as specified in claim 3 wherein the expandable material is rubber.

5. The electronic cigarette and fluid dispensing system as specified in claim 1 wherein said fluid dispenser further comprises a lip that extends around the perimeter of the dispenser body's first end, wherein said lip maintains said plunger within said body, making it impossible to pull said plunger out from said body's first end.

6. The electronic cigarette and fluid dispensing system as specified in claim 1 wherein the dimensions of each respective said first aperture and said second aperture facilitate control over the insertion of safe, non-nicotine fluid or nicotine fluid into said e-cig.

7. The electronic cigarette and fluid dispensing system as specified in claim 1 wherein the means for visually differentiating which type of fluid is being smoked, or vaped, comprises indicia that allows users and observers of said E-Cig FDS the ability to identify which type of fluid is inserted into said e-cig and whether nicotine-laced water vapor is emanating form said e-cig or being exhaled by the user.

8. The electronic cigarette and fluid dispensing system as specified in claim 1 wherein the means for visually differentiating which type of fluid is being smoked, or vaped, comprises a light consisting of a LED that is located on the outer end of said e-cig, wherein a particular color of LED light indicates a safe non-nicotine fluid is being utilized, or a different color LED light indicates that a nicotine fluid is being used.

* * * * *